United States Patent [19]

Kitamura et al.

[11] 4,329,413

[45] May 11, 1982

[54] ELECTROPHOTOGRAPHIC PROCESS CAPABLE OF FORMING OVERLAID IMAGES AND APPARATUS FOR CARRYING OUT THE SAME

[75] Inventors: Takashi Kitamura, Yokohama; Michio Ito, Hachioji, both of Japan

[73] Assignee: Canon Kabushiki Kaisha, Tokyo, Japan

[21] Appl. No.: 121,657

[22] Filed: Feb. 15, 1980

Related U.S. Application Data

[63] Continuation-in-part of Ser. No. 104,706, Dec. 17, 1979.

[30] Foreign Application Priority Data

Feb. 23, 1979 [JP] Japan ..... 54/20255
Feb. 23, 1979 [JP] Japan ..... 54/20256

[51] Int. Cl.[3] ..... G03G 13/22

[52] U.S. Cl. ..... 430/54; 430/55; 430/67

[58] Field of Search ..... 430/55, 54, 67

[56] References Cited

U.S. PATENT DOCUMENTS 3,730,709 5/1973 Kinoshita et al. ..... 430/55
3,813,243 5/1974 Kitajima et al. ..... 430/55
3,871,878 3/1975 Mino et al. ..... 430/54
3,904,408 9/1975 Hanada et al. ..... 430/67
4,052,206 10/1977 Anzai ..... 430/55
4,071,361 1/1978 Marushima ..... 430/55

*Primary Examiner*—Richard L. Schilling
*Assistant Examiner*—John L. Goodrow
*Attorney, Agent, or Firm*—Fitzpatrick, Cella, Harper & Scinto

[57] ABSTRACT

The present invention is directed to process and apparatus for overlaying images making use of steps constituting a known electrophotographic process. The electrophotographic process on which the present overlay process depends is of the type in which a three-layered photosensitive member having an insulating covering layer as the top layer of the member is used. The surface of the insulating layer is charged with an electric charge simultaneously with an imagewise irradiation for a first image to be overlaid or during the time of a photo hysteresis resulted from the first image-forming irradiation being still present in the photoconductive layer of the photosensitive member. Then, AC discharging or charging with an electric charge of opposite polarity to that of the above electric charge is effected. Thereafter, an imagewise irradiation for second image is carried out to obtain an electrophotographically overlaid image from the first and second images.

8 Claims, 34 Drawing Figures

ELECTROPHOTOGRAPHIC PROCESS CAPABLE OF FORMING OVERLAID IMAGES AND APPARATUS FOR CARRYING OUT THE SAME

This is a continuation-in-part application of U.S. Ser. No. 104,706 filed on Dec. 17, 1979.

BACKGROUND OF THE INVENTION

1. Field of the Invention

The present invention relates to an electrophotographic process capable of forming an overlay image from a first image and a second image.

2. Description of the Prior Art

In the field of electrophotography there are already known various systems such as electrofax system, xerox system, P.I.P. (persistent internal polarization) system and NP system which is disclosed for example in the U.S. Pat. Nos. 3,666,363 and 4,071,361.

The electrofax and xerox systems depends upon so-called Carlson process as described in the U.S. Pat No. 2,297,691 wherein a layer of a photoconductive material such as zinc oxide (for electrofax system) or amorphous selenium (for xerox system) provided on a substrate is uniformly charged with a corona discharge and then subjected to an imagewise exposure to light to dissipate the charge in the exposed area, and an electrostatic image thus obtained corresponding to the original pattern is rendered visible by development with charged colored particles and fixed on said layer or after transfer onto another support material such as a paper sheet to obtain an electrophotographic image. The P.I.P. system utilizes the physical properties, i.e. persistent internal polarization for forming a latent image. Also the NP system utilizes the photoconductivity and electrostatic capacitance of a photoconductive layer and an insulating layer provided thereon for forming an electrostatic latent image, which is subsequently subjected to the steps of development, transfer and fixing in a similar manner to obtain an electrophotographic image.

Although various copying apparatus have been developed on these electrophotographic processes, such apparatus have been unable to satisfactorily meet, except for a limited extent, the increasing demand for exposing plural different originals onto a photosensitive member to obtain an overlaid latent image and thus to obtain an overlaid visible image. Also the prior image overlay processes principally depend on optical overlay of plural images or on electrically overlaid signals, and there have been known very few overlay processes for forming an overlay image on a photosensitive member by combining different steps constituting an electrophotographic process.

An example of such known overlay process utilizing the above-mentioned NP system is disclosed in the U.S. Pat. No. 4,122,462 assigned to the assignee of the present application. The present invention is to provide another overlay process and an apparatus adapted therefor.

SUMMARY OF THE INVENTION

Accordingly, it is an object of the invention to provide a simple image overlay process capable of satisfying the above-mentioned demand through the combination of steps constituting an electrophotographic process, and an apparatus adapted for conducting the image overlay process.

It is another object of the invention to provide a process and apparatus for forming an electrophotographically overlaid image from first and second images depending upon the electrophotographic process employing a three-layered photosensitive medium having an insulating covering layer through the steps of charging the surface of the insulating layer with an electric charge simultaneously with first image-forming irradiation or during the time of a photo hysteresis resulted from the irradiation being still present in the photoconductive layer, subjecting it to AC discharging or charging with an electric charge of opposite polarity to that of the above charge and applying thereto a second image-forming irradiation.

According to one aspect of the present invention to attain above objects there are provided such electrophotographic process and apparatus which are based on the electrophotographic method employing a photosensitive medium essentially composed of an electrically conductive substrate, a photoconductive layer and an electrically insulating layer and which are featured in that the surface of the insulating layer is charged simultaneously with a first image-forming irradiation or subsequent to the first image-forming irradiation but during the time of a photo hysteresis resulted from the irradiation being still present in the photoconductive layer, the charged surface is subjected to AC discharging and then it is exposed to a second image-forming irradiation to form an overlaid electrostatic latent image from the first and second images.

According to another aspect of the invention there are provided such electrophotographic process and apparatus which are also based on the photographic method employing a photosensitive medium essentially composed of a conductive substrate, a photoconductive layer and an insulating layer and which are featured in that the surface of the insulating layer is charged simultaneously with a first image-forming irradiation or subsequent to the first image-forming irradiation but during the time of a photo hysteresis resulted from the irradiation being still present in the photoconductive layer, applied to the charged surface an electric charge of opposite polarity to that of the above charge and then it is exposed to a second image-forming irradiation to form an overlaid electrostatic latent image from the first and second images.

According to a further aspect of the invention there are provided such electrophotographic process and apparatus in which the first and second images are positionally synchronized to form an overlaid electrostatic latent image.

In brief, according to preferred embodiments of the invention, the electrophotographic process according to the present invention is, in principle, carried out in the following manner:

To carry out the process of the invention there is used a photosensitive medium essentially composed of an electrically conductive substrate, a photoconductive layer and an electrically insulating layer. The apparatus charges the surface of the insulating layer of the photosensitive medium with positive or negative electric charge simultaneously with a first light image-forming irradiation or subsequent to the irradiation but during the time of a photo hysteresis resulted from the irradiation being still present in the photoconductive layer. After subjecting the charged surface to AC discharging or corona discharge with opposite polarity to that of the above electric charge, man exposed it to a second light image-forming irradiation. Thereby a substantial difference in the surface potential is produced between the area corresponding to the light part of both of the first and second light images and the remaining area. Thus, an overlaid electrostatic latent image is formed from the first and second light images. The electrostatic latent image thus formed is developed with a developing agent mainly composed of charged colored particles and the visualized image is transferred onto a transfer member such as a paper sheet making use of internal or external electric field. After transferring, the image is fixed by means of thermal rays using suitable fixing means such as an infrared ray lamp or heating plate to obtain a final electrophotographic print. On the other hand, after transferring, the surface of the insulating layer is subjected to a cleaning step to remove any remaining charged particles. After cleaning, the photosensitive medium gets prepared for reuse in the next cycle of operation.

Still other objects and advantages of the present invention will become apparent from the following description of the embodiments thereof to be taken in conjunction with the attached drawings.

DESCRIPTION OF THE PREFERRED EMBODIMENTS

EMBODIMENT 1

Figure 1:
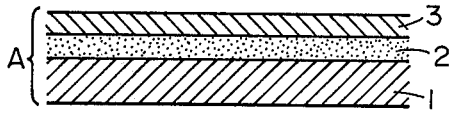
FIG. 1 is a schematic illustrative view of the structure of a photosensitive member adapted for use in the present invention.

Referring to FIG. 1 there is schematically shown a photosensitive member employed for forming an electrostatic image, wherein 1 is an electroconductive substrate, 2 is a photoconductive layer which is provided on said conductive substrate 1 for example by spraying or coating with a coater or a wheeler and which may contain a small amount of binder such as a resin for improving the adhesion to other layers, and 3 is an insulating layer uniformly adhered on said photoconductive layer 2. In this manner the photosensitive member A is essentially of three-layered structure composed of the conductive substrate, photoconductive layer and insulating layer, but it is also possible to add a control layer for limiting the charge displacement between the conductive substrate and the photoconductive layer and/or to add a charge trapping layer on the surface of said photoconductive layer or in the vicinity thereof. Also the photoconductive property of the photosensitive member should preferably be such as to have a dark resistance as high as possible.

The conductive substrate 1 may be made of a metal such as tin, copper, aluminum, etc. or a hydroscopic paper but can be conveniently made of paper laminated with an aluminum foil because of low cost and convenience for use in case of winding on a drum. The photoconductive layer may be composed of CdS, CdSe, crystalline Se, ZnO, ZnS, Se, $TiO_2$, SeTe, PbO or the mixtures thereof.

Also, there may be used a layer of such photosensitive material having a property of so-called photo hysteresis effect as disclosed, for example, in Japanese Patent Publication No. 44,902/1974. This type of the photosensitive layer, when irradiated by light, becomes reduced in resistance value and is rendered conductive. Even after terminating the light irradiation, it can continue to be conductive for a certain time, which is referred to as photo hysteresis effect.

As certain photoconductive layers have a charge injection property of causing the injection of charge of a particular polarity from the conductive substrate to the photoconductive layer at the step of electrostatic charging in the dark, the primary charging in the embodiments explained in the following is conducted with a polarity not causing such charge injection in case said property of such photoconductive layer undesirably affects the charge distribution obtained by the first image exposure to be conducted substantially simultaneously or subsequent to said primary charging. However the primary charging may be conducted at either polarity in case the photoconductive material employed has substantially no charge injection property or in case said property of the photoconductive material has substantially no effect on the charge distribution obtained by said first exposure.

The insulating layer 3 may be composed of a material satisfying three requirements of a high abrasion resistance, a high resistance for maintaining the electrostatic charge thereon and a transparency, and can therefore be composed of a layer of fluorine resins, polycarbonate resins, polyethylene resins, cellulose acetate resins, polyester resins, etc. among which fluorine resins are preferred in the embodiments of the present invention because of easily cleanable character thereof which facilitates the repeated use of the photosensitive member through the steps of development, image transfer and cleaning as will be explained later.

Figure 2:
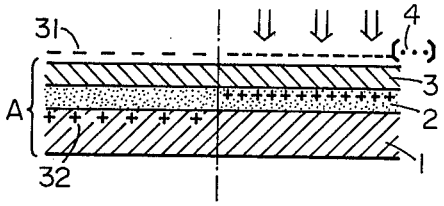
FIGS. 2 to 4 are explanatory views showing the steps of forming an overlaid latent image through exposures of first and second image-forming irradiation onto the photosensitive member shown in FIG. 1.
Figure 3:
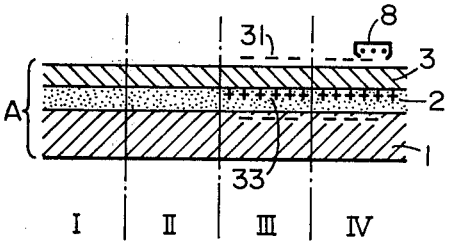
Figure 4:
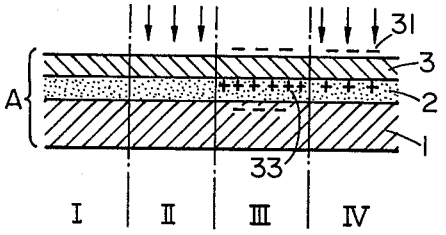

FIGS. 2 to 4 illustrate the steps of forming an overlaid latent image on the photosensitive member of the above-mentioned structure, and the charge patterns in said steps.

At first, at the step shown in FIG. 2 the apparatus carries out a first light image-forming irradiation to the photosensitive member A. Simultaneously with the irradiation or subsequent to the irradiation but during the time of a photo hysteresis resulted from the irradiation being still present in the photoconductive layer, the apparatus charges the surface of the insulating layer 3 with selected polarity of electric charge, for example, with negative (−) charge by a corona discharge 4. Since the resistance of the photoconductive layer 2 is high in the dark area at this time, there are induced at the dark area positive (+) charges 32 in the interface between the conductive substrate 1 and the photoconductive layer 2 or in the portion of the photoconductive layer near the substrate 1. At the light area, on the contrary, the photoconductive layer 2 is rendered conductive by stimulus of light and positive charges are injected from the conductive substrate 1. These injected charges are drawn by the surface charges (−) on the insulating layer and stay at the area in the vicinity of the interface between the layers 2 and 3 as interfacial charge 33 (FIG. 2). In this process, the surface potential on the insulating layer 3 increases in negative direction with charging time in both of the light area and the dark area as shown by the characteristic curve Vp in FIG. 5.

It is desirable that the corona discharger 4 be designed to have an optically opened upper portion in order to permit light image irradiation substantially simultaneous with corona discharge. It may be achieved by making the upper portion of the corona discharger 4 transparent or leaving the upper portion open without shield plate.

At the next step shown in FIG. 3, an AC corona discharge is applied to the surface of the insulating layer 3 by an AC corona discharger 8. At areas I and II which were dark at the time of the first light image-forming irradiation, all or a major portion of the negative charges 31 on the surface of the insulating layer 3 are discharged by this AC corona discharge because of no binding force acting on the negative charge. On the contrary, at areas III and IV which were light at the first light image-forming irradiation, the negative (−) charges 31 on the surface of the insulating layer 3 are bound by positive (+) charges 33 staying in the vicinity of the interface because of the high resistance of the photoconductive layer 2 at those areas. Therefore, at areas III and IV, the negative charges 31 on the surface of the insulating layer 3 are discharged by the AC corona in a far lower degree than that at areas I and II, that is, the dark area at the time of the first light image-forming irradiation. In this manner, in the light area of the first light image there remain a large amount of negative charge on the surface of the insulating layer 3. However, at the same time, a large amount of positive charge 33 also remain staying near the interface between the layers 2 and 3. Under the condition, the electric field produced by the surface charge of the insulating layer acts, to a great extent, in the direction toward the positive charge 33 staying in the photoconductive layer 2 and therefore the external field by the surface charge becomes extremely small (FIG. 3).

At the step shown in FIG. 4, an exposure of the second light image is carried out from the surface side of the insulating layer 3 (this exposure may be carried out from the side of the conductive substrate provided that the substrate is light transmissive).

Figure 5:
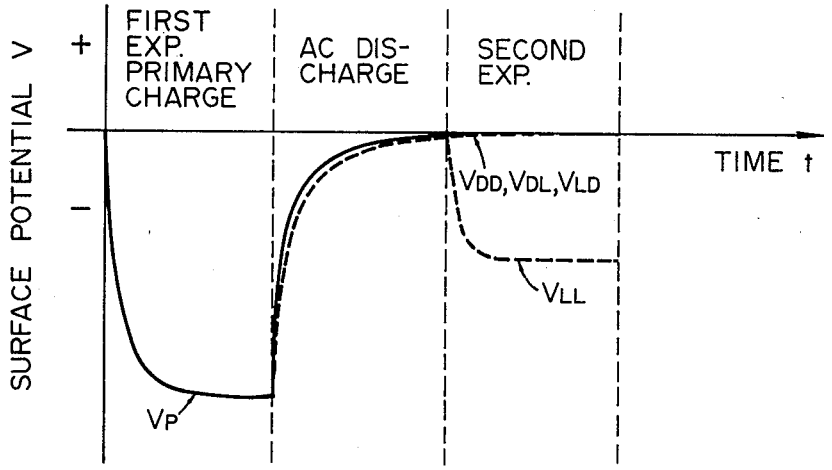
FIG. 5 is a chart schematically showing the change of the surface potential in the steps shown in FIGS. 2 to 4.

Change of the surface potential in the above three steps is shown in FIG. 5. Symbol DD used there means the area which was the dark area of the first light image and also the dark area of the second one. Similarly, DL means the area which was the dark area of the first light image and the light area of the second one, LD the area which was the light area of the first light image and the dark area of the second one and LL the area which was the light area of the first light image and also the light area of the second one. Upon the second light image exposure at the last step shown in FIG. 4, no substantial change of charge distribution is produced within the photoconductive layer at the areas I (DD), II (DL) and III (LD) from the state of the charge distribution at the end of the second step shown in FIG. 3. Therefore, as seen from the curve in FIG. 5, the surface potential ($V_{DD}$, $V_{DL}$, $V_{LD}$) on the insulating layer 3 at the second exposure remains unchanged and is at the level of nearly 0 (V) in these areas. In contrast, however, at the area IV (LL), the surface potential changes remarkably at the time of the second exposure. Since the area is irradiated by light at the second exposure, the resistance of the photoconductive layer is abruptly and greatly reduced in the area IV which renders the photoconductive layer conductive. Now, the positive charges 33 which have stayed within the photoconductive layer until the second exposure are all dissipated through the conductive substrate 1 excepting only a small amount of charge equivalent to the negative charge 31 on the surface of the insulating layer 3. As a result, the external field on the surface charge 31 increases intensively and therefore the surface potential $V_{LL}$ rises up in the negative direction in FIG. 5. Thus, as seen from the characteristic curve in FIG. 5, the surface potential at the end of the process is high only in the area IV where the potential is $V_{LL}$ whereas $V_{DD}$, $V_{DL}$ and $V_{LD}$ in the remining areas I, II and III are all in the level of nearly 0(V).

By developing the photosensitive member A with toner after the above process, therefore, an image resulting from the first and second light images, that is, an overlaid image can be visualized.

Figure 6:
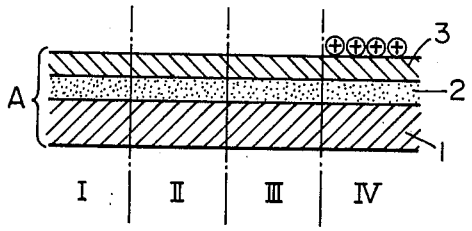
FIGS. 6 and 7 are explanatory views showing the steps of rendering the latent image visible.

FIG. 6 illustrates the case in which the latent image is developed with toner whose polarity is opposite to that previously used for the primary charging, namely with toner having positive polarity. In this case, the toner is adhered to the area IV exclusively.

Figure 7:
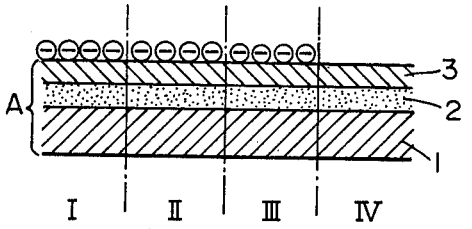
Figure 8:
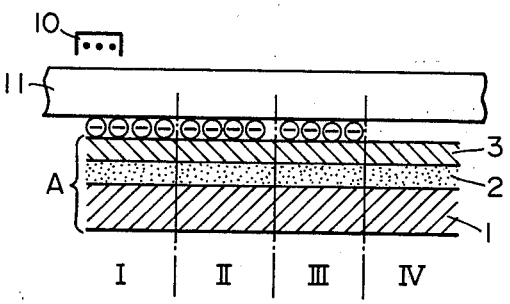
FIG. 8 is an explanatory view showing the step of transferring the visible image.
Figure 9A:
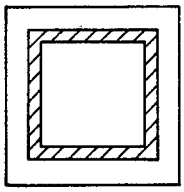
FIGS. 9A to 12D are views showing various examples of the patterns of the first and second images and of the overlaid visible image.
Figure 9B:
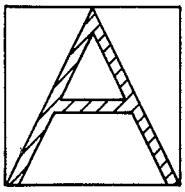
Figure 9C:
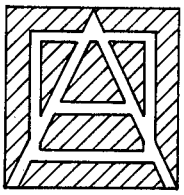
Figure 9D:
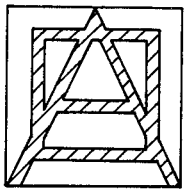
Figure 10A:
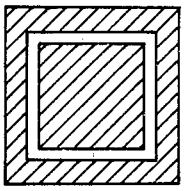
Figure 10B:
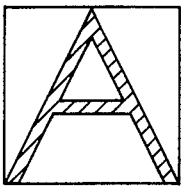
Figure 10C:
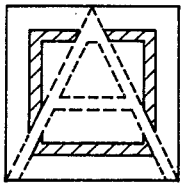
Figure 10D:
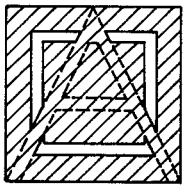
Figure 11A:
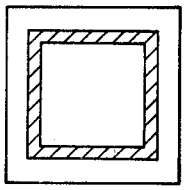
Figure 11B:
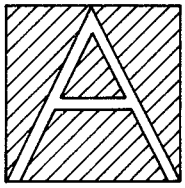
Figure 11C:
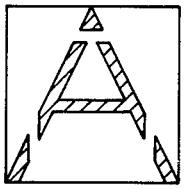
Figure 11D:
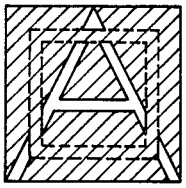
Figure 12A:
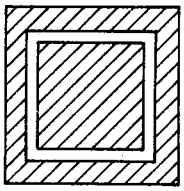
Figure 12B:
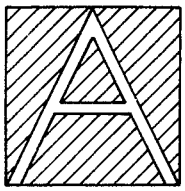
Figure 12C:
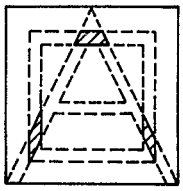
Figure 12D:
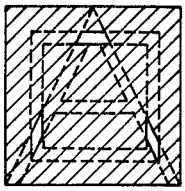

FIG. 7 illustrates the case of reversal development. In this case, development of the latent image is carried out using such toner having the same polarity as that of the primary charge. Contrary to the above mentioned regular development, the toner is, in this case, adhered to the areas I, II and III exclusively. As well-known to those skilled in the art, a better result can be obtained by using a set of developing electrodes in the latter mentioned case.

FIGS. 9 through 12 show various examples of image patterns. In each example, (a) is a pattern for first light image original, (b) for second light image original, (c) for overlaid image obtained from the two originals (a) and (b) after developing with positively charged toner and (d) for overlaid image obtained from the two originals after developing with negatively charged toner. As will be understood from these examples of overlaid images, many different visualized overlaid images can be obtained by changing the combination of light and dark patterns as well as positive and negative in polarity for the first and second light images. As an overlaid image the combination shown in FIG. 9 is most preferred.

After developing, the visualized image formed on the insulating layer is transferred onto a transfer member 11 which may be a paper sheet or the like by using a corona discharger 10 or by applying an external voltage using any other bias voltage applying means or using the internal field. The transferred image is finally fixed by using any suitable fixing means such as infrared rays, heating plate or pressure fixing device to obtain a final electrophotographic print.

On the other hand, after transferring, the surface of the insulating layer is cleaned off by a cleaning method known per se to remove any remaining charged particles from the surface and to prepare the photosensitive member for repeated operation. A better cleaning effect can be obtained when the cleaning is carried out after the charges applied on the surface of the insulating layer at the light area of the original to form the electrostatic latent image have previously been removed from the surface. To this end, the coated insulating film surface is at first subjected to AC corona discharge to remove the charges used to form the electrostatic latent image and then subjected to a cleaning treatment by an elastic cleaning blade or fur brush. In this case, the effect of cleaning can be further improved by providing said cleaning means with opposite polarity of charge to the polarity of the charged colored particles then used.

Since the cleaning effect also depends upon the mechanical properties, in particular adhesive property of the material of the insulating layer, fluorine resin is the best material for the insulating layer although all of the aforementioned resins are suitable. The film of fluorine resin is excellent in non-adhesive property and facilitates the removal of the charged colored particles from the surface at the time of cleaning. Therefore, a remarkedly high effect of cleaning is obtainable when a fluorine resin film is used as the insulating layer.

For good development, an electrostatic latent image to be developed is required to satisfy the following conditions:

(1) there should be present a sufficiently large difference in surface potential between $V_{LL}$, and $V_{DD}$, $V_{DL}$, $V_{LD}$ and (2) there should not be produced any substantial difference in surface potential among $V_{DD}$, $V_{DL}$, $V_{LD}$.

To satisfy the above requirements, one must suitably select the following factors:

(1) photoconductive substance 2, (2) exposure values for the first and second images, (3) polarity and intensity of the primary charge, and (4) intensity of AC corona discharge.

To explain the process of forming an electrostatic latent image according to the invention more concretely and quantitatively an example is given below.

To 100 g of cadmium sulfide activated by copper is added 10 g of vinyl chloride and then a small amount of thinner. The resultant mixture is mixed together thoroughly to form a photoconductive material. The photoconductive material is coated on the polished surface of an aluminum cylinder to form a coating layer of 50$\mu$ in thickness. Then, an insulating layer of 35$\mu$ thick is overlaid on the photoconductive layer. Thus, a photosensitive member is prepared.

The photosensitive member is exposed to a first light image (quantity of light at the light area: about 40 lux/-sec.) while applying +6.5 KV of corona discharge onto the surface of the insulating layer simultaneously. Subsequently, the photosensitive member is exposed to a second light image with the same quantity of light as that for the first image. In this manner, a high contrast electrostatic latent image is formed on the surface of the insulating layer. In this process of forming the electrostatic image, the surface potential was measured with a surface electrometer to know the difference of surface potential between the part corresponding to $V_{LL}$ in FIG. 5 and the part corresponding to $V_{LD}$, $V_{DD}$, $V_{DL}$. The difference of surface potential was found to be about 400 V.

Figure 13:
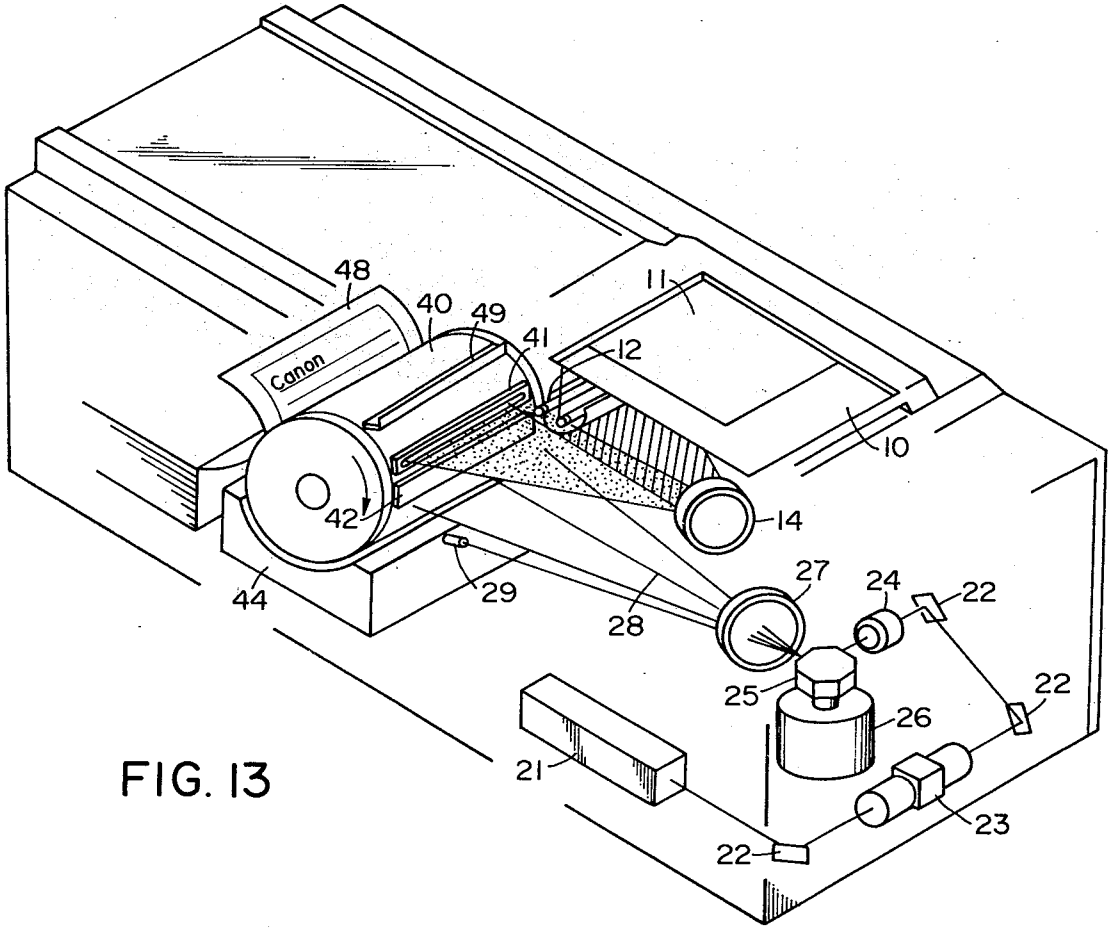
FIG. 13 is a perspective view of an embodiment of the electrophotographic apparatus of the present invention.
Figure 14:
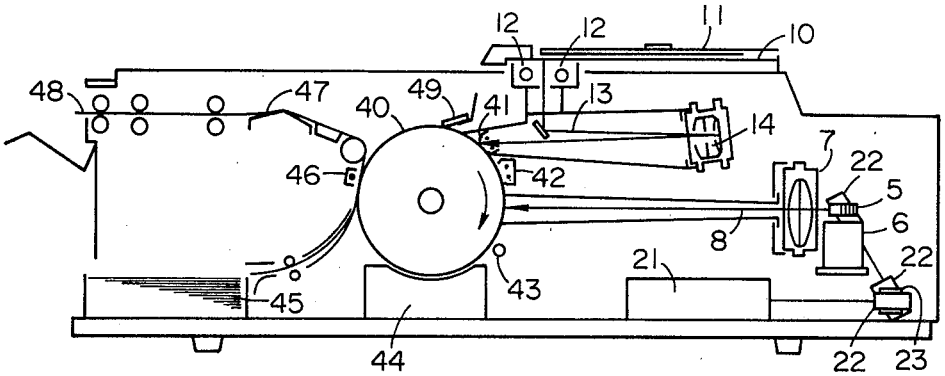
FIG. 14 is a lateral cross-sectional view of said apparatus.

Now referring to FIGS. 13 and 14 a preferred embodiment of the present invention is described in detail. In the embodiment, the invention is applied to a laser beam recording apparatus provided with additional overlaying function such as a fixed format. FIG. 13 shows the apparatus in perspective view and FIG. 14 in cross-sectional view.

Referring to FIGS. 13 and 14, an original 11 for example for a fixed format is placed on an original carriage 10 movable in synchronization with the laser exposure as will be explained later and is illuminated with an exposure lamp 12, and the reflected light is directed by a mirror 13 to an original imaging lens 14 and is exposed as a first exposure as will be explained later onto a photosensitive drum 40.

A second exposure is achieved by a laser beam in synchronization with the first original exposure in a manner as explained in the following. The laser beam emitted by a laser oscillator 21 is guided through a mirror 22 to the entrance aperture of a deflector-modulator 23. Said mirror is employed for reducing the space in the apparatus and may be dispensed with if unnecessary. The deflector-modulator 23 is composed of an acousto-optical modulating element utilizing a known acousto-optical effect or an electro-optical modulating element utilizing a known electro-optical effect. The laser beam is intensity modulated and simultaneously deflected in said deflector-modulator 23 according to the input signals thereto.

The modulator 23 can be omitted in case of a semiconductor laser or in case there is employed another laser, for example a gas laser, of a type capable of current modulation or incorporating a modulating element in the oscillation optical path.

The laser beam from the modulator 23 is guided to a beam expander 24 which expands the diameter of said beam while maintaining the parallel state thereof. The laser beam of thus expanded diameter is introduced to a rotary polygonal mirror 25 having one or plural mirror faces. Said polygonal mirror 25 is mounted on a shaft supported by a precision bearing, for example a pneumatic bearing, and is rotated by a constant-speed motor 26, for example a hysteresis synchronous motor or a DC servomotor, to perform a scanning operation in the horizontal direction. Said scanning operation may also be performed by a galvanometer mirror.

The laser beam put into horizontal scanning motion by said rotary polygonal mirror 25 is focused as a spot on a photosensitive drum 40 through an imaging lens 27 having an f-$\theta$ characteristic.

In an ordinary imaging lens the focus position r on the image plane is related to the incident angle $\theta$ of the beam by the following equation:

$$r = f \cdot \tan \theta \qquad (1)$$

wherein f is the focal length of said lens. The incident angle to the lens 27 of the laser beam 28 reflected by the rotary polygonal mirror 25 of a constant speed as in the present embodiment changes linearly with the time, so that the displacing speed of the focused spot on the photosensitive drum 40 is not constant but shows a non-linear change, giving a higher displacing speed for a larger incident angle. Consequently, in response to the laser beam turned on at a constant interval, the spots obtained on the photosensitive drum 40 become spaced wider on both sides of the drum than in the center thereof. In order to prevent such phenomenon the imaging lens is designed to have the following characteristic:

$$r=f\cdot\theta \quad (2)$$

and such lens is called an f-$\theta$ lens. Also in case of focusing a parallel beam into a spot with an imaging lens, the minimum spot diameter $d_{min}$ is given by the following equation:

$$d_{min}=f\lambda/A \quad (3)$$

wherein:
f: focal length of the imaging lens;
$\lambda$: wavelength of the light; and
A: incident aperture of the imaging lens;
so that a smaller spot diameter can be obtained for given values of f and $\lambda$ by increasing the value of A. The aforementioned beam expander is employed for this reason. Consequently said expanded beam can be dispensed with in case a desired value of $d_{min}$ is obtainable with the beam diameter of the laser oscillator. There is provided a beam detector 29 which is composed of a small entrance slit and a high-speed photoelectric transducer such as a PIN diode, and which detects the position of the laser beam 28 in scanning motion thereby determining the timing for starting the input signals to said modulator 23 for providing desired optical information to the photosensitive drum. In this manner it is rendered possible to significantly reduce the aberration of signals in the horizontal direction resulting from eventual errors in the accuracy of reflecting faces of the rotary polygonal mirror 25 and also from eventual uneven rotation of said mirror, thereby improving the image quality, widening the tolerance required for the rotary polygonal mirror 25 and the drive motor 26 and permitting the lower manufacturing cost of the apparatus.

In the above-explained manner the photosensitive drum 40 is exposed to the laser beam 28 modulated by the external signals as the second exposure as will be explained later.

Now there will be explained the printing section of the apparatus shown in FIGS. 13 and 14. At first the photosensitive member 40 essentially composed of a conductive substrate, a photoconductive layer and an insulating layer is subjected to a first exposure of an original such as a fixed format through a primary corona discharge 41, substantially simultaneously with a negative charging of the surface of said insulating layer by means of said discharger 41.

The photosensitive member 40 is rotated in the direction indicated by the arrow. When the area of the photosensitive member subjected to the first exposure comes to the position of AC corona discharger 42, the area is subjected to the action of AC corona discharge. Thereafter, in positionally synchronized relation with the previous first exposure, a laser beam exposure is carried out on the insulating layer surface as a second exposure.

As result of the above process there is produced a difference of surface potential between the area exposed to both the light of the first exposure (light area of original: white background) and the laser beam of the second exposure ($V_{LL}$ in FIG. 5) and the remaining area so that an overlaid electrostatic latent image is formed.

As already described referring to FIG. 5, after the first and second exposures the surface of the insulating layer has negative charges remaining exclusively at the area which was the light part both in the first and second exposures, and therefore at that area it has a negative surface potential $V_{LL}$. At the remainder of the surface, the surface potential becomes nearly 0.

The overlaid electrostatic latent image is then rendered visible by developing means 44. When reversal development of the latent image is wished, a developing agent mainly composed of negatively charged, colored particles is used. After developing, the visualized image is transferred onto a transfer member 45 which may be a paper sheet or the like with the aid of internal or external electric field 46 and then fixed by means of fixing means 47 which may be an infrared lamp, heating plate or pressure fixing device to obtain an electrophotographic print 48. On the other hand, the photosensitive member 40 is subjected, after the image transfer, to a cleaning step for removing the remaining charged particles from the surface of said insulating layer by cleaning means 49 and thus is prepared for repeated use in the succeeding operation cycle.

In the above described embodiment, when the latent image is developed in a manner of reversal development, the charged colored developing particles are adhered to the areas I and II (dark areas at the first exposure) and to the area III (light area at the first exposure but dark area at the second one) exclusively. Therefore, as the original such as a format for the first exposure it is allowed to use a positive original which can be prepared relatively easily. Furthermore, the signal control of laser beam for the second exposure can be performed employing such known control system for laser beam recording apparatus without any alternation or modification which has been developed in these years.

Also the foregoing embodiment has been explained by an application thereof to a laser beam recording apparatus having an overlay function for example for a fixed format, but it is also applicable to other apparatus having a similar overlay function, such as an apparatus utilizing a cathode ray tube in place of the laser or an apparatus composed of an electrophotographic copier and a microfilm blow up printer.

Now there will be explained the method of achieving positional synchronization or registration between the first exposure and the second exposure. Such synchronization is naturally unnecessary in certain cases, for example when the first or second exposure is utilized for making repetitive background patterns.

The first and second exposures to be synchronized may appear in the following combinations:

(1) First exposure by the light reflected from an original, and second exposure by a laser beam;

(2) First and second exposures by the lights reflected from originals;

(3) First and second exposures by laser beams; and (4) First exposure by laser beam, and second exposure by the light reflected from an original.

Naturally the light reflected from an original may be replaced by a light transmitted from a transparent film or an enlarged light from a microfilm original, and the laser beam may be replaced by other spot-forming beams for example from a cathode ray tube.

The synchronizing methods in these four combinations will be explained in the following. At first the combination (1) corresponds to the apparatus of the foregoing embodiment.

Figure 15:
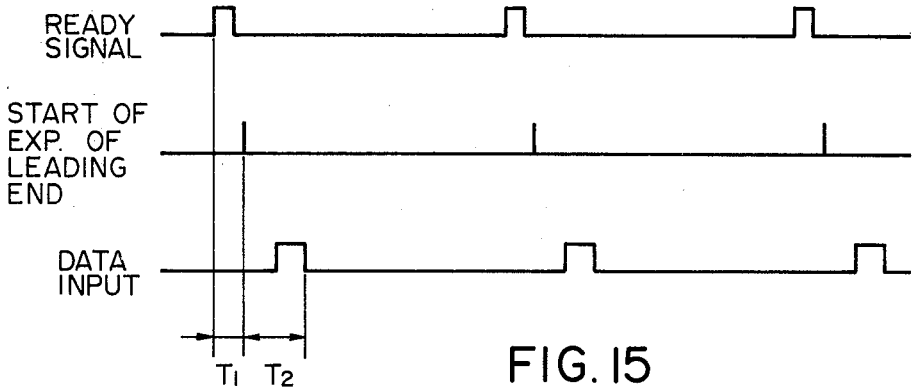
FIGS. 15 and 16 are time-charts showing the synchronizing systems respectively for the first and second image-forming exposures in the above-mentioned embodiment of the present invention.

Referring to FIGS. 13 and 14, the original carriage 10 displacing at a constant speed actuates an unrepresented microswitch at a determined position to generate a ready signal as shown in FIG. 15. The exposure of the leading end of the original is initiated after a determined time $T_1$, and thereafter the exposure with laser beam is initiated in response to the data signal after a controlled time $T_2$.

The time $T_2$ from start of exposure of leading end of the original to the start of laser beam exposure is given by:

$$T_2=(E_2-E_1)/V_p$$

wherein $E_2-E_1$: distance between the first and second exposure positions $v_p$: peripheral speed of photosensitive drum.

The time chart in this case is shown in FIG. 15. The time $T_1$ is determined mechanically by the relation between the position of the switch for generating the ready signal and the position of leading end of the original, while the time $T_2$ is determined electrically for example by a known counting means.

In the following there is explained is an example of synchronizing method in the case (2) wherein the first and second exposures are both made with lights reflected from originals.

Figure 17:
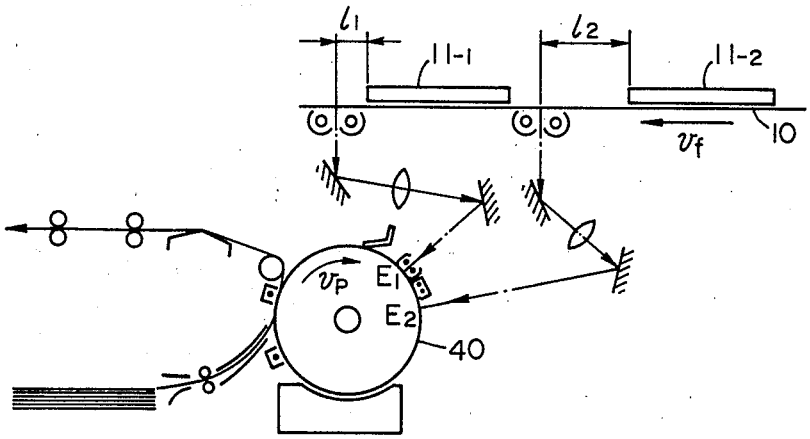
FIGS. 17 and 18 are explanatory views showing two examples of said synchronizing system.

Referring to a structure shown in FIG. 17, the positional synchronization of the first and second originals can be achieved if the following relationship is selected between the leading end positions of the first and second originals 11-1, 11-2 and the first and second exposure positions E1, E2 onto the photosensitive drum:

$$(l_2-l_1)/v_f=(E_2-E_1)/v_p$$

wherein $l_1$: distance of displacement of original carriage before reaching a constant-speed displacement or a larger distance $l_2-l_1$: distance between leading ends of first and second originals $v_f$: speed of original carriage $V_p$: peripheral speed of photosensitive drum $E_2-E_1$: distance between first and second exposure positions.

The above-mentioned synchronized displacements can be achieved by already known means.

Now there will be shown an example of synchronizing method in the case (3) wherein the first and second exposures are both conducted by laser beams. In this case the synchronization can be achieved by initiating the second laser exposure after a time $T_2$ from the first laser exposure, said time $T_2$ being electrically determined so as to satisfy the following equation:

$$T_2=(E_2-E_1)/V_p$$

wherein $E_2-E_1$: distance between the first and second exposure positions; and $V_p$: peripheral speed of photosensitive drum.

In the following there is explained is an example of synchronizing method in the case (4) in which the first exposure is achieved with a laser beam while the second exposure is conducted with the light reflected from an original.

Figure 16:
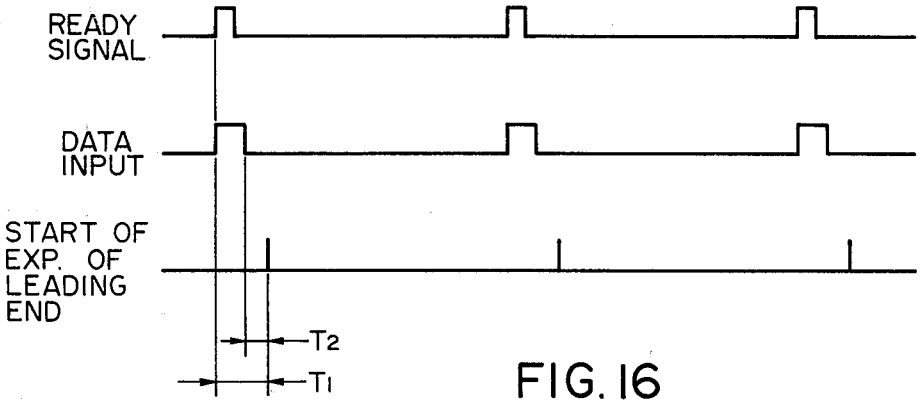
Figure 18:
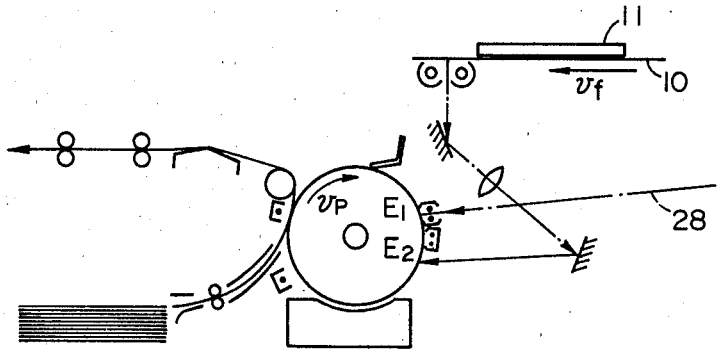

Referring to FIG. 18, the original carriage 10 displaced at a constant speed generates a ready signal at a determined position as shown in FIG. 16. After a controlled time therefrom, the exposure with the laser beam 28 is initiated in response to the entered data signals. Also the time is controlled in such a manner that the exposure of the leading end of the original 11 is initiated when the initially laser-exposed portion of the photosensitive drum is rotated to the second exposure position by the light reflected from the original. Thus the time $T_2$ from the start of data signals to the laser to the start of exposure of the leading end of the original 11 is represented by:

$$T_2=(E_2-E_1)/v_p$$

wherein $E_2-E_1$: distance between the first exposure position with laser beam and the second exposure position at which the exposure of leading end of the original is initiated; and $v_p$: peripheral speed of the photosensitive drum.

Also the time $T_1$ from the ready signal to the start of exposure of the leading end of the original is given by:

$$T_1=(l_r-f)/vf$$

wherein $l_r-f$: distance from the switch position for generating the ready signal to the leading end position of the original; and $v_f$: displacing speed of the original carriage.

Said ready signal can be obtained for example from a microswitch positioned so as to be actuated by the displacement of the original carriage.

As will be apparent from the time chart shown in FIG. 16, the timing of data signal supply is controlled so as to be synchronized with the start of exposure of the leading end of the original by regulating the time $T_1$ and $T_2$, namely from the ready signal to the start of exposure with laser beam or to the start of exposure of the leading end of the original.

In the foregoing there has been given a brief explanation on the synchronizing methods for the first and second images.

EMBODIMENT 2

Figure 19:
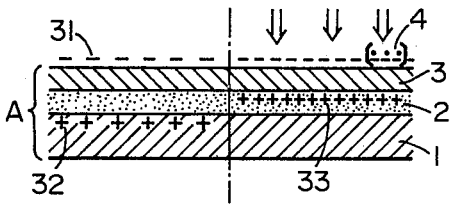
FIGS. 19 to 21 are explanatory views showing the steps of a second embodiment of the present invention.
Figure 20:
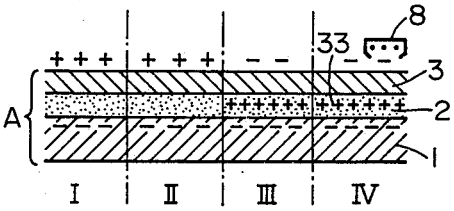
Figure 21:
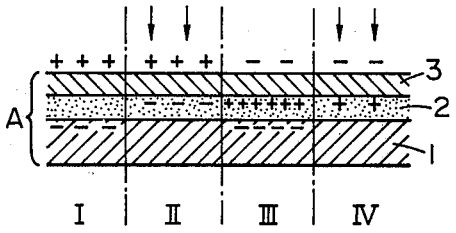
Figure 22:
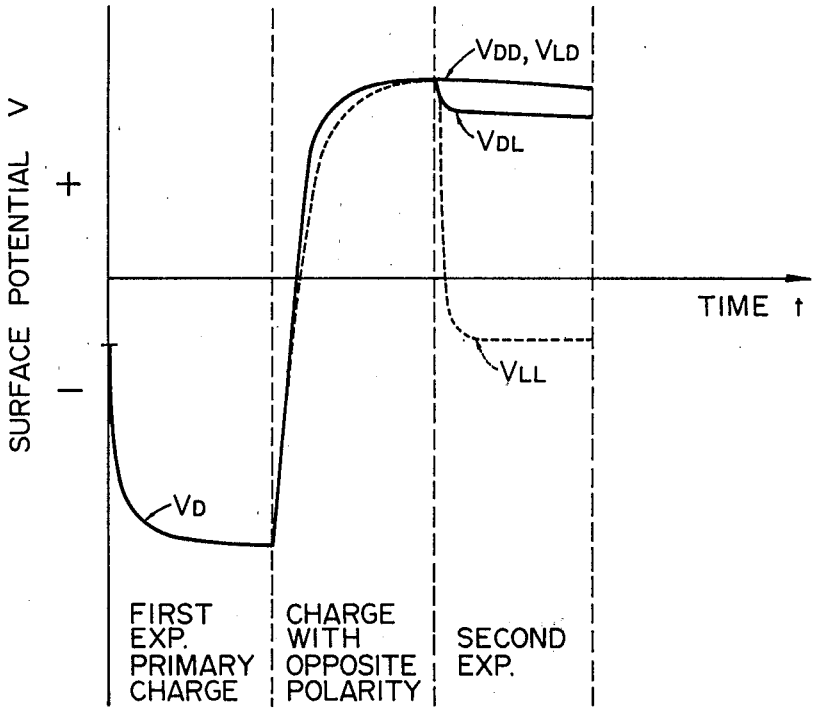
FIG. 22 is a chart showing the change of the surface potential in the steps shown in FIGS. 19 to 21.

FIGS. 19 to 22 illustrate the second embodiment of the present invention, wherein FIGS. 19 to 21 show the steps corresponding to those of the first embodiment shown in FIGS. 2 to 4 while FIG. 22 correspond to FIG. 5, in which common components are represented by common numbers.

The particular feature of this second embodiment is found in that AC discharging in the first embodiment is replaced by application of DC discharge having a polarity opposite to that of the primary charge.

At the first step shown in FIG. 19, the photosensitive member A is exposed to a first light image while charging the surface of the insulating layer 3, for example, negatively (−) by the primary charging corona discharge 4 simultaneously with the exposure or subsequent to the exposure but during the time of a photo hysteresis resulted from the exposure being still present in the photoconductive layer. At this step, in the dark area of exposure the photoconductive layer 2 remains highly resistant and therefore, in the dark area, there is induced a positive (+) charge 32 in the interface between the layers 1 and 2 or at the portion of the photoconductive layer 2 close to the substrate layer 1. On the contrary, in the light area of exposure, the photoconductive layer 2 is rendered conductive by the stimulus of light. Therefore, in the light area, a positive (+) charge is injected into the layer 2 from the conductive substrate 1 and the injected positive charge is drawn by the surface charge (−) on the insulating layer 3. This results in an interfacial charge 33 staying near the interface between the layers 2 and 3. Through this process the surface potential on the insulating layer 3 increases with charging time in the negative (−) direction in both the light and dark areas as shown by the characteristic curve $V_p$ in FIG. 22.

As previously described, to allow the light image exposure nearly simultaneous with the corona discharging it is desirable that the corona discharger 4 for primary charging be so designed as to have an upper part optically opened. This may be achieved, for example, by providing the corona discharger with a transparent upper part or leaving the upper part uncovered without any shield plate.

At the next step shown in FIG. 20, the apparatus applies to the surface of the insulating layer 3 a positive (+) corona discharge, namely, a corona discharge of opposite polarity to that of the above primary charge, using the corona discharger 8. By this corona discharge the negative (−) charge 31 at the areas I and II (dark area in the first light image exposure) of the insulating layer surface is neutralized by the secondary charged opposite (+) charge and further the surface of the insulating layer 3 is charged with the polarity (+) of the secondary charging at these areas. On the other hand, at the areas III and IV (light area in the first light image exposure), the negative (−) charge previously formed on the insulating layer surface 3 by the primary charging is neutralized only partly by the opposite (+) charge of the secondary charging. Even if all of the negative charges are neutralized by the positive charge, the insulating layer surface 3 will be charged with the polarity (+) of the secondary charging in a very low degree in the areas III and IV as compared with the areas I and II. This is because the positive charges 33 remain in the photoconductive layer 2 in spite of the secondary charging. As described above, since the primary charging is carried out simultaneously with the first light image exposure or during the time of a photo hysteresis resulted from the exposure being still present in the photoconductive layer 2, positive charges 33 are formed in the vicinity of the interface between the layers 2 and 3. These positive charges 33 remain there during the step of secondary charging because of the presence of a blocking layer on the photoconductive layer surface and high resistance of the photoconductive layer. The secondary charging can not dissipate the remaining positive charge 33. Therefore, it seems that the electric field resulting from the remaining positive charge 33 prevents the insulating layer surface 3 from being charged with the polarity of the secondary charging to a great extent.

At the last step shown in FIG. 21, the photosensitive member is exposed to a second light image.

Since, as previously noted, no substantial charge in charge distribution occurs at the areas I and III (dark area in the second exposure) of the photosensitive member A, the positive charge on the insulating layer surface maintains its stabilized state with the negative charge. Therefore, at these areas, almost no decay of the surface charge is observed so that the surface potential at these area I and III remains nearly constant.

At area II which was dark in the first exposure and light in the second one, some drip of the surface potential is observed ($V_{DL}$).

However, this change of the surface potential at this area is far smaller than the change in $V_{LL}$ of which description will be made hereinafter.

At area IV which was light in the first exposure and also light in the second one, the surface potential on the insulating layer is abruptly and markedly reduced during this step of second exposure. At the previous step, this area was not subjected to light irradiation and therefore the resistance of the photoconductive layer was high in this area. Now, at this step of second exposure, the area is exposed to light and therefore the resistance of the photoconductive layer is intensively reduced and the latter layer is rendered conductive. As a result, the positive charges 33 remaining in the interface between the layers 1 and 2 at the previous step are all dissipated excepting only such charges which are bound by the surface charges on the insulating layer. This results in an abrupt drop of the surface potential $V_{LL}$ as seen in FIG. 22. At this time, if all of the negative charges applied by the primary charging have not been neutralized yet by the positive charges applied by the secondary charging, the change of surface potential in this area is not the only drop. Rather, there appears a negative surface potential due to the negative charges remaining on the surface of the insulating layer. All of these changes in surface potential on the insulating layer surface occurring through the above three steps give the characteristic curves in FIG. 22.

It is therefore possible to obtain an overlaid visible image of said first and second images by developing the photosensitive member A in this state in a manner similar to that in the first embodiment.

The method of utilizing the overlaid latent image thus prepared and the possibility of using the reflected light and the laser beam in the formation of said latent image in this second embodiment need not be explained in detail. It will be readily understood by those skilled in the art that the foregoing description made with reference to FIG. 6 and also in connection with the first embodiment is also applicable to this second embodiment with a modification that AC discharging is replaced by a secondary charging with a polarity opposite to that of the primary charging.

To explain the electrophotographic method according to the second embodiment more specifically and quantitatively, an example is given below.

To 100 g of cadmium sulfide activated by copper is added 10 g of vinyl chloride and further a small amount of thinner. The mixture is thoroughly mixed together to form a photoconductive material. The photoconductive material is coated on the polished surface of an aluminum cylinder to form a coating layer of 50$\mu$ thick. An insulating layer of 35$\mu$ thick is overlaid on the photoconductive layer. Thus, a photosensitive member is prepared.

The photosensitive member is exposed to a first light image (quantity of light at the light area: about 40 lux/sec.) while simultaneously subjecting the surface of the insulating layer to corona discharge of +6.5 KV.

Thereafter, a secondary charging is carried out by using a corona discharge of −6 KV. Then, the photosensitive member is exposed to a second light image with the same quantity of light as that in the first exposure to form an electrostatic image. In this process of forming the electrostatic image, the surface potential was measured with a surface electrometer. The difference in surface potential between the part corresponding to $V_{LL}$ in FIG. 5 and the part corresponding to $V_{DD}$, $V_{LD}$ was found to be about 400 V (there was also found a slight difference between $V_{DL}$ and $V_{DD}$).

The present invention is not limited to the above embodiments only. Various modifications can be made therein without departing from the scope and spirit of the present invention.

As will be clearly understood from the foregoing, the present invention relates to the electrophotographic process and apparatus employing a photosensitive medium essentially composed of an electrically conductive substrate, a photoconductive layer and an electrically insulating layer. The electophotographic process and apparatus according to the invention are characterized by the steps of exposing the photosensitive medium to a first light image while charging the surface of the insulating layer with a primary charge simultaneously with the first exposure or subsequent to the first exposure but during the time of the photo hysteresis resulted from the first exposure being still present in the photoconductive layer, then subjecting the same to AC discharging or a secondary charging with a polarity opposite to that of the primary charging and exposing it to a second light image thereby forming an overlaid electrostatic latent image from said first and second images.

In the above process, the first and second images are positionally synchronized to form an overlaid electrostatic latent image. By variously changing the combination of the first and second images, many different overlay latent images are obtainable in the above steps of the process according to the invention. This is one of the important effects of the invention. Making use of the effect of the invention it is allowed to make an image forming apparatus adaptable for many different applications. Therefore, the present invention is particularly useful for overlay recording of various data or information.

Also, according to the invention, the AC discharging or secondary charging need not to be carried out simultaneously with the second image exposure. This makes it easy to design a mechanical apparatus used for carrying out the process of the invention. Moreover, a relatively free selection is allowed for exposure time. It is also an advantage of the invention that a close contact exposure of original is possible.

What we claim is:

1. A process for forming an overlay latent image comprising the steps of:

applying a first image-forming irradiation onto a photosensitive medium essentially composed of an electrically conductive substrate, a photoconductive layer having substantially no charge injection property, and an electrically insulating layer;

applying a primary electric charge onto the surface of said insulating layer in relation to the change in conductivity of said photoconductive layer caused by said first image-forming irradiation;

applying a corona discharge onto the surface of said insulating layer after applying the primary electric charge; and applying a second image-forming irradiation on said photosensitive medium thereby forming on the surface of said insulating layer an overlaid latent image from said first and second images.

2. A process according to claim 1, wherein said first and second images are positionally synchronized to form the overlaid electrostatic latent image.

3. A process according to claim 1, wherein said first image-forming irradiation is provided by an optical image of an original, while said second image-forming irradiation is provided by an optical beam spot.

4. A process according to claim 1, wherein said first and second image-forming irradiations are respectively provided by optical images of originals.

5. A process according to claim 1, wherein said first image-forming irradiation is provided by an optical beam spot, while said second image-forming irradiation is provided by an optical image of an original.

6. A process according to claim 1, wherein said first and second image-forming irradiations are provided by optical beam spots.

7. An electrophotographic process employing a photosensitive medium essentially composed of an electrically conductive substrate, a photoconductive layer having substantially no charge injection property, and an insulating layer, which process comprises the steps of:

charging the surface of said insulating layer during the time of a first image-forming irradiation or during the time of a photo hysteresis resulting from said irradiation being still present in said photoconductive layer;

effecting AC discharging; and applying a second image-forming irradiation thereby forming an overlaid electrostatic latent image from said first and second images.

8. An electrophotographic process employing a photosensitive medium essentially composed of an electrically conductive substrate, a photoconductive layer having substantially no charge injection property, and an insulating layer, which process comprises the steps of:

charging the surface of said insulating layer during the time of a first image-forming irradiation or during the time of a photo hysteresis resulting from said irradiation being still present in said photoconductive layer;

charging said surface with electric charge whose polarity is opposite to that of the above said charge; and applying a second image-forming irradiation thereto thereby forming an electrostatic latent image of an overlaid image from said first and second images.

* * * * *